United States Patent [19]

Brander

[11] Patent Number: 4,574,495

[45] Date of Patent: Mar. 11, 1986

[54] METHOD AND DRYING PLANT FOR DRYING A MATERIAL IN BATCH OPERATION

[75] Inventor: Stephan Brander, Würenlingen, Switzerland

[73] Assignee: Zschokke Wartmann AG, Switzerland

[21] Appl. No.: 604,617

[22] PCT Filed: Jul. 27, 1983

[86] PCT No.: PCT/CH83/00091

§ 371 Date: Apr. 11, 1984

§ 102(e) Date: Apr. 11, 1984

[87] PCT Pub. No.: WO84/00805

PCT Pub. Date: Mar. 1, 1984

[30] Foreign Application Priority Data

Aug. 23, 1982 [CH] Switzerland ..... 5006/82

[51] Int. Cl.[4] ..... F26B 3/04

[52] U.S. Cl. ..... 34/15; 34/33; 34/92; 34/207

[58] Field of Search ..... 34/92, 5, 207, 203, 34/236, 15, 33, 208, 179, 181, 182, 183

[56] References Cited

U.S. PATENT DOCUMENTS

| | | | |
|---|---|---|---|
| 888,257 | 4/1908 | Passburg | 34/92 |
| 1,418,638 | 6/1922 | Frankel . | |
| 2,121,370 | 6/1938 | Touton | 34/208 |
| 2,528,476 | 10/1950 | Roos et al. | 34/5 |
| 3,022,752 | 2/1962 | Voisine | 34/208 |
| 3,206,866 | 9/1965 | McCabe | 34/92 |
| 3,270,432 | 9/1966 | Barbareschi | 34/92 |
| 3,324,565 | 6/1967 | Smith, Jr. | 34/92 |
| 3,354,609 | 11/1967 | Nerge . | |
| 3,448,527 | 6/1969 | Hernandez . | |
| 4,409,744 | 10/1983 | Sturgeon et al. | 34/208 |

FOREIGN PATENT DOCUMENTS

| | | |
|---|---|---|
| 67437 | 3/1892 | Fed. Rep. of Germany . |
| 3006126 | 9/1981 | Fed. Rep. of Germany . |
| 2402171 | 3/1979 | France . |
| 560899 | 4/1944 | United Kingdom . |
| 989148 | 4/1965 | United Kingdom . |

*Primary Examiner*—Larry I. Schwartz

*Attorney, Agent, or Firm*—Roylance, Abrams, Berdo & Goodman

[57] ABSTRACT

Such a drying plant has drying surfaces (4) superposed in a chamber (1) and extending over the depth of the chamber (1). The drying surfaces (4) are provided with heating plates (3). The upper run of an endless conveyor belt running on rollers (6,7) is guided over the drying surfaces. The material to be dried is applied by a dosing device via a pipe (9) having branches (10) to the moving belts (5) uniformly over the width until the entire drying surface (4) is covered. The belts (5) are then stopped and the dosing operation is completed. The drying operation is then carried out on the drying surface (4) while the belts (5) are stationary. The belts (5) are then moved in the opposite direction, so that the dried material is thrown off via the rollers (7) and discharged through a discharge opening (13) and a charging valve (14). Thus, the drying operation is carried out under optimum conditions known for drying cabinets. However, the operations of feeding and discharging the material are simplified as compared with conventional drying cabinets and can also be automated.

5 Claims, 2 Drawing Figures

METHOD AND DRYING PLANT FOR DRYING A MATERIAL IN BATCH OPERATION

Figure 1:
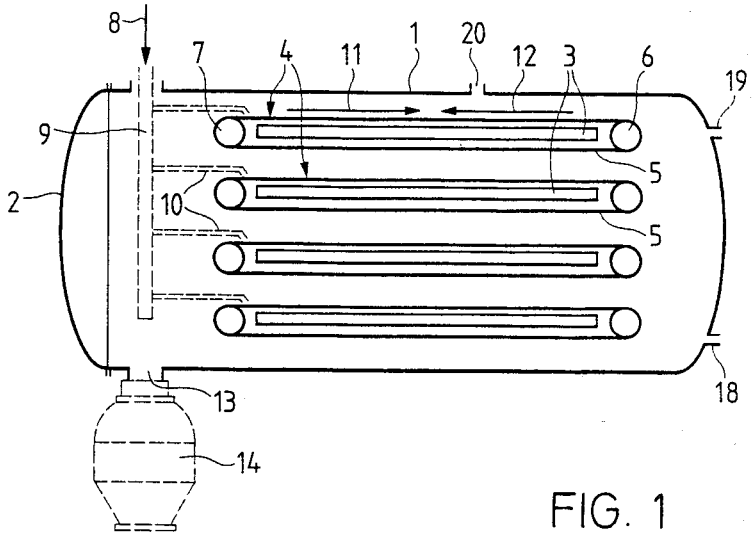

The present invention relates to a method for drying a material in batch operation in a closed drying space with the supply of heat. After putting the material into the drying space it is dried on at least one stationary drying surface. The present invention also relates to a drying plant for carrying out said method.

The drying of materials, i.e. the removal of moisture from all kinds of materials, is a frequently applied method of process engineering by means of which the materials are rendered durable or put into a state suitable for shipments or further processing. Among the methods used the method with artificial heat supply is a frequently used method. In the direct drying process the material to be dried is directly exposed to hot gases, for example, combustion gases, while in the indirect drying process, which is used primarily for sensistive material the drying is brought about by means of air, water, or the like, heated by heat exchangers.

The present invention relates to an indirect drying process which is carried out with a suitable drying plant. A corresponding drying plant is known in two embodiments. In one embodiment the drying plant is a drying cabinet which is a closed chamber. Heating plates which are heated by a heat carrier are disposed in several layers on the inside of said drying cabinet. The material to be dried is distributed over trays e.g. manually or also with a feeding device. The trays are then placed in the drying cabinet. The batch put into the drying cabinet in this manner is dried while heat is supplied. The internal pressure can be reduced to a vacuum and adapted to the dry process. When the drying is completed the batch distributed over the trays is removed from the drying cabinet, which is then prepared for drying the next batch. In the drying cabinet the drying process can be controlled in an ideal manner by adjusting the temperature and the pressure. Furthermore, the capital costs are relatively low. However, the fact that an automatic operation is practically impossible and that, therefore, a great deal of attendance is required is a disadvantage. The expenditure for keeping the drying cabinet clean also is high. However, any kind of material, i.e., materials ranging from the fluid to the lumpy state, can be dried.

A further known drying plant is the belt-type dryer, which can also be designed as a vacuum belt dryer. As in the drying cabinet a pressure-resistant chamber is used. Heating plates are disposed in said heating chamber in several superposed layers and in several series-connected zones, usually four or more zones. The heating plates are located below the upper run of endless belts, which are guided over a friction roller and a guide roller and can be driven by a motor. The material to be dried is guided into the inside of the chamber by means of a dosing device and uniformly distributed over the belts. Corresponding to the motion of the belts, the material is conveyed from the first zone to the zones therebehind. The temperature conditions can be adjusted differently in each zone so that the material is heated and dried in stages. At the guide roller of the rearmost zone the dried product is exposed outwardly and can be removed by the belt, for example, by pulling it off. However, the pressure conditions in the chamber, for example, maintaining a vacuum, are identical for all the drying zones of the belt-type dryer. The advantage of the belt-type dryer lies in that it has a greater capacity than a drying cabinet operated in batches, that it permits continuous operation and that it can thus be operated automatically with justifiable expenditure. Furthermore, the operating costs and the expenditure for hygiene or cleaning are low. However, the fact that not just any material, particularly no thinly liquid or lumpy material, but only pumpable and fluid materials can be dried in a belt-type dryer is a disadvantage.

The problem of the invention is to so develop the aforementioned drying method that it combines the advantages of both the drying cabinet and the belt-type dryer. This problem is solved in that the material introduced into the drying space before the drying operation is charged manually or mechanically onto the drying surface and distributed thereon by a conveying means.

According to the invention this method is performed by a drying plant 20, in which the drying surface is formed by a conveyor belt which is stationary during the drying operation.

Figure 2:
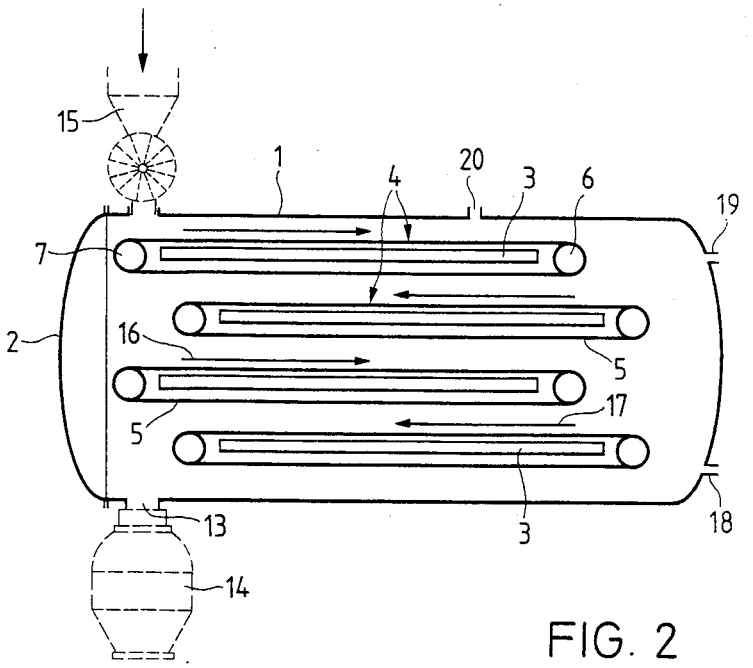

An embodiment of the invention is described hereinafter relative to the diagrammatic drawings, in which:

FIG. 1 is a longitudinal section of the drying plant according to the invention; and FIG. 2 is a variant of the drying plant of FIG. 1 for drying fluid materials.

The drying plant shown in the FIGS. 1 and 2 has a chamber 1, which is a pressure-and vacuum-resistant tray. At least on one front end, the chamber 1 has a cover 2, which can be removed when required and thus provides access to the chamber 1.

Four heating plates 3 are superposed inside the chamber 1, but the number of heating plates 3 can be greater or smaller. With their arrangement in a single zone this corresponds to the arrangement in a drying cabinet wherein stationary superposed drying surfaces 4 are provided. On said surfaces the material to be dried is kept in suitable receptacles which are prepared and introduced as charges prior to the drying process and can be removed as such from the drying cabinet after the drying process.

It is important that the expensive batchwise loading and emptying of the drying cabinet, which cannot be avoided can be simplified and automated by the use of conveying devices.

According to the embodiments shown in the FIGS. 1 and 2 these conveying devices are movable belts 5 which also form the stationary drying surfaces 4. The belts 5 are endless belts and are guided via a driving pulley 6 and a guide roll 7. The two rolls 6 and 7 are supported in a frame fixed in the chamber 1 or they are supported in the chamber wall in a manner which is not shown. The driving pulleys 6 may be driven in various ways. Either all the driving pulleys are driven simultaneously or only a single driving pulley 6 is driven consecutively so that the belts 5 are moved consecutively. However, during the drying process all the belts 5 are stationary. For the use of the drying cabinet according to FIG. 1 for drying a pumpable material said material is fed by means of a conveying feeding device symbolized by the arrow 8 through a pipe 9 into the interior of the chamber 1. This feeding conveying device can be rigidly installed or it can be mobile and driven up to the belts through the open dryer. Branches 10 extend from the pipe 9 to the individual belts 5 or the belts are successively charged consecutively. Only one nozzle charging the belts consecutively is used. The belts 5 are thus put into motion so that the material emerging from the orifices of the branches 10 is distributed over both the width of the belts 5 and the length of the drying surface 4. When the entire drying surface 4 is covered with the material the belts 5 are stopped. The drying operation is now the same as that in a drying cabinet while temperature and pressure are adjusted corresponding to the material to be dried. The feeding device of the belts 5 is marked by the arrow 11. When the drying operation is completed the belts are moved in the direction of the arrow 12 or 11 opposed to the direction of motion or in the same direction of motion as in the charging operation of the drying surface. The dried material is then thrown off and discharged from the drying chamber through a discharge opening 13. Depending on the system said discharge opening is disposed on the charging side or on the side opposed thereto and is provided with a charging valve 14. As an alternative a suitable retractable discharge vessel can be disposed within the vacuum space. The pipe 9 having the branches 10 can thus be raised and used for breaking the dried material into pieces so that the dried material can be thrown off without obstruction.

A new batch can now be fed via the pipe 9 having the branches 10 into the drying chamber and the belts 5 are moved in the direction of the arrow 11 until the entire drying surface is loaded, whereupon the drying operation commences with the belts at a stand still.

In the embodiment according to FIG. 2 a fluid material, which is fed through a diagrammatically represented bucket wheel 15 into chamber 1, is processed therein. This dosing device can be installed rigidly or movable analogously to the feeding device for liquid products. Unlike in the embodiment according to FIG. 1 heating plates 3 and drying surfaces 4 formed by belts 5 are alternately staggered in this embodiment. If the belts move alternately in opposite directions corresponding to arrows 16, 17 the fluid material charged onto the uppermost belt 5 is placed on the beginning of the underlying belt 5, from where it in turn passes onto the next underlying belt 5 and so on until the material reaches the end of the lowermost belt 5. The belts 5 are then stopped and the drying process starts on the stationary drying surfaces.

For the discharge of the dried material from the drying chamber according to FIG. 2, the belts are moved in the same direction of arrows 16, 17 so that the dried material can be discharged, for example, through discharge opening 13 and charging valve 14. Here again the charging valve can be replaced e.g. by an extendable discharge vessel installed within the vacuum space. Immediately on completing the discharge, the drying plant is ready for drying the next batch. In the drying chamber according to FIG. 2, like that according to FIG. 1, the belts are moved only until the loading of the drying surface with material to be dried is completed or until the dried material is completely discharged after the drying operation.

A further advantage of the drying chamber according to FIGS. 1 and 2 is that apart from automatic charging by random devices, manual charging is also possible for materials which are particularly difficult to treat, for which purpose cover 2 can be opened. Depending on the material to be charged, one belt 5 after another can be moved and charged in the drying chamber according to FIG. 1. However, all the belts 5 can be moved and charged simultaneously. In the drying chamber according to FIG. 2 the charging operation can be carried out in the same manner, but in most cases the charging operation is carried out with the belts 5 running in opposite directions from top to bottom.

Pipe connections 18, 19 for guiding in and out the heat carrier for the heating plates 3 are provided on chamber 1. A further pipe connection 20 connects a vacuum producer, for example, jet pumps or liquid seal pumps.

Steel or plastics, for example, PTFE, can be used as the material for the conveyor belts 5. With the drying plants described—as in the known drying cabinet—particularly any material can be dried with the exception of very thinly liquid materials.

I claim:

1. A method of drying material in a batch operation, comprising the steps of:

conveying material to be dried into a closed drying space having heating means and onto a conveyor belt in the drying space;

moving the conveyor belt in a first direction to distribute the material on the conveyor belt;

stopping movement of the conveyor belt and maintaining the conveyor belt stationary during a discontinous drying stage when the material is being dried on the conveyor belt by heat from the heating means; and after the drying stage, moving the conveyor belt in a second direction, opposite to the first direction, with dried material thereon to discharge the dried material from the conveyor belt.

2. A drying apparatus, comprising:

a closed drying space with heating means;

a plurality of movable conveyor belts mounted within said drying space;

drive means engagable with said conveyor belts, all but one of said conveyor belts being disengagable with said drive means;

feed means for conveying material to be dried into said drying space and onto one end of at least one of said conveyor belts; and control means for regulating operation of said heating means, said conveyor belts and said feed means such that material to be dried is conveyed onto said conveyor belts while said conveyor belts, movement of said conveyor belts is stopped and said conveyor belts are moved to distribute the material on the said conveyor belts, are maintained stationary during a discontinuous drying stage when the material on said conveyor belts are being dried by said heating means, and after the drying stage said conveyor belts are moved with the dried material thereon to discharge the dried material from said conveyor belts.

3. A drying apparatus according to claim 2 wherein said plurality of conveyor belts are superposed in said drying space, said conveyor belts being alternatively, longitudinally offset with adjacent conveyor belts movable in opposite directions, whereby material conveyed off the end of one conveyor belt falls onto an end of the conveyor belt therebelow.

4. A drying apparatus according to claim 2 wherein said plurality of conveyor belts are superposed in said drying space.

5. A drying apparatus according to claim 2 wherein said drying space comprises a vacuum drying cabinet.

* * * * *